US005664549A

United States Patent [19]

Hutchins

[11] Patent Number: 5,664,549

[45] Date of Patent: Sep. 9, 1997

[54] BREATHER SYSTEM FOR AN INTERNAL COMBUSTION ENGINE

[75] Inventor: William Richard Hutchins, Kenilworth, England

[73] Assignee: Rover Group Limited, Birmingham, England

[21] Appl. No.: 591,311

[22] Filed: Jan. 25, 1996

[30] Foreign Application Priority Data

Jan. 28, 1995 [GB] United Kingdom ..... 9501713

[51] Int. Cl.[6] ..... F01M 13/04; F01L 1/053

[52] U.S. Cl. ..... 123/572

[58] Field of Search ..... 123/572, 573, 123/574, 41.86

[56] References Cited

U.S. PATENT DOCUMENTS

| | | | |
|---|---|---|---|
| 4,493,295 | 1/1985 | Ampferer | 123/572 |
| 4,597,372 | 7/1986 | Furukawa . | |
| 4,607,604 | 8/1986 | Kanoh et al. | 123/572 |
| 4,721,090 | 1/1988 | Kato . | |
| 4,723,529 | 2/1988 | Yokoi et al. . | |
| 4,862,860 | 9/1989 | Shinohara | 123/572 |
| 4,922,881 | 5/1990 | Tamba et al. | 123/572 |
| 5,129,371 | 7/1992 | Rosalik, Jr. . | |

FOREIGN PATENT DOCUMENTS

| | | |
|---|---|---|
| 0 448 431 | 9/1991 | European Pat. Off. . |
| 0 448 431 A1 | 2/1991 | France . |
| 2 125 482 | 3/1984 | United Kingdom . |
| 2 131 484 | 6/1984 | United Kingdom . |

OTHER PUBLICATIONS

Yahiro Kazuma, "Valve Chamber Structure for Internal Combustion Engine", Aug. 1, 1994, The Abstract.

Misaku Tomohiro, "Oil Separator in PCV System", Jun. 21, 1994, The Abstract.

Ota Katsuya, "Engine Oil Supply Port Structure For Internal Combustion Engine", Jan. 16, 1992, The Abstract.

Iwata Noriyuki, "Cylinder Head Structure of Engine", Apr. 6, 1993, The Abstract.

*Primary Examiner*—Marguerite McMahon

*Attorney, Agent, or Firm*—Davis and Bujold

[57] ABSTRACT

An internal combustion engine has a cylinder head assembly with a camshaft 28 mounted therein and breather passages 70 through it. A guard member 38 is mounted on the head casting 12 and includes guards 40 over the cams 42 side walls 39 and a bearing ladder for the camshaft. A gasket 46 between the guard member 38 and a cover 44 forms, with the guard member 38, a separation region 50 having an inlet 72 fed by the breather passages and outlets 51 in the form of holes through the gasket 46. The gas can flow from the breather passages to the outlets 51 is slow and substantially horizontal so oil can separate out of the gas. The guards 40 prevent oil from the cams 42 from mixing with the breather gases.

9 Claims, 4 Drawing Sheets

BREATHER SYSTEM FOR AN INTERNAL COMBUSTION ENGINE

FIELD OF THE INVENTION

The present invention relates to the separation of oil from gases in internal combustion engines.

BACKGROUND TO THE INVENTION

Internal combustion engines generally require a breather system to take gas, which escapes from the cylinders into the crankcase region, up through the cylinder block and head and out through the cover from where they are fed back into the air intake system for the cylinders. The breather gases generally pass up through oil drainage passages in the engine. In engines with overhead camshafts they therefore pass around the cam shaft, which tends to result in significant amounts of oil being carried out with the breather gases which increases the unwanted emissions from the engine.

Various developments have been made to overcome this problem by separating the region in the cylinder head through which gases flow from the camshaft, as shown, for example, in GB 2 125 482. However the present invention aims to provide a simpler and more effective solution to the problem.

SUMMARY OF THE INVENTION

The present invention provides an internal combustion engine having a cylinder head assembly including a camshaft with a plurality of cams and camshaft bearings supporting the camshaft, the head assembly defining at least one breather passage extending therethrough and an oil separation region connected to said at least one breather passage such that, in use, gas can flow from said at least one breather passage through the separation region where oil can separate out of the gas, wherein the head assembly further comprises a guard member having guard portions which separate the oil separation region from the cams and camshaft bearing portions which form part of the camshaft bearings.

Separate oil drainage passages can be provided from the camshaft and valve area down through the head and block to the sump.

Preferably the cross section of the separation region is significantly larger than that of the said at least one breather passage such that the gas is slowed down in the separation region. This allows the oil in the gas to drop out more easily in the separation region.

Preferably the separation region is arranged such that the flow of the gas through the separation region has a significant horizontal component. This also helps oil separation.

Preferably the engine further comprises a cover defining an outlet region and retardation means, such as a gasket, which separates the outlet region from the separation region, and the separation region includes inlet means and retardation means has apertures therethrough which form outlet means and are offset from the inlet means.

Preferably the guard member includes a guard over each cam of the camshaft.

Conveniently the head assembly includes a cylinder head member, the guard member being mounted on the head member and the cover being mounted on the guard means.

Preferably the head member has camshaft bearing portions which cooperate with those on the guard member to form the camshaft bearings.

DESCRIPTION OF THE PREFERRED EMBODIMENTS

Figure 1:
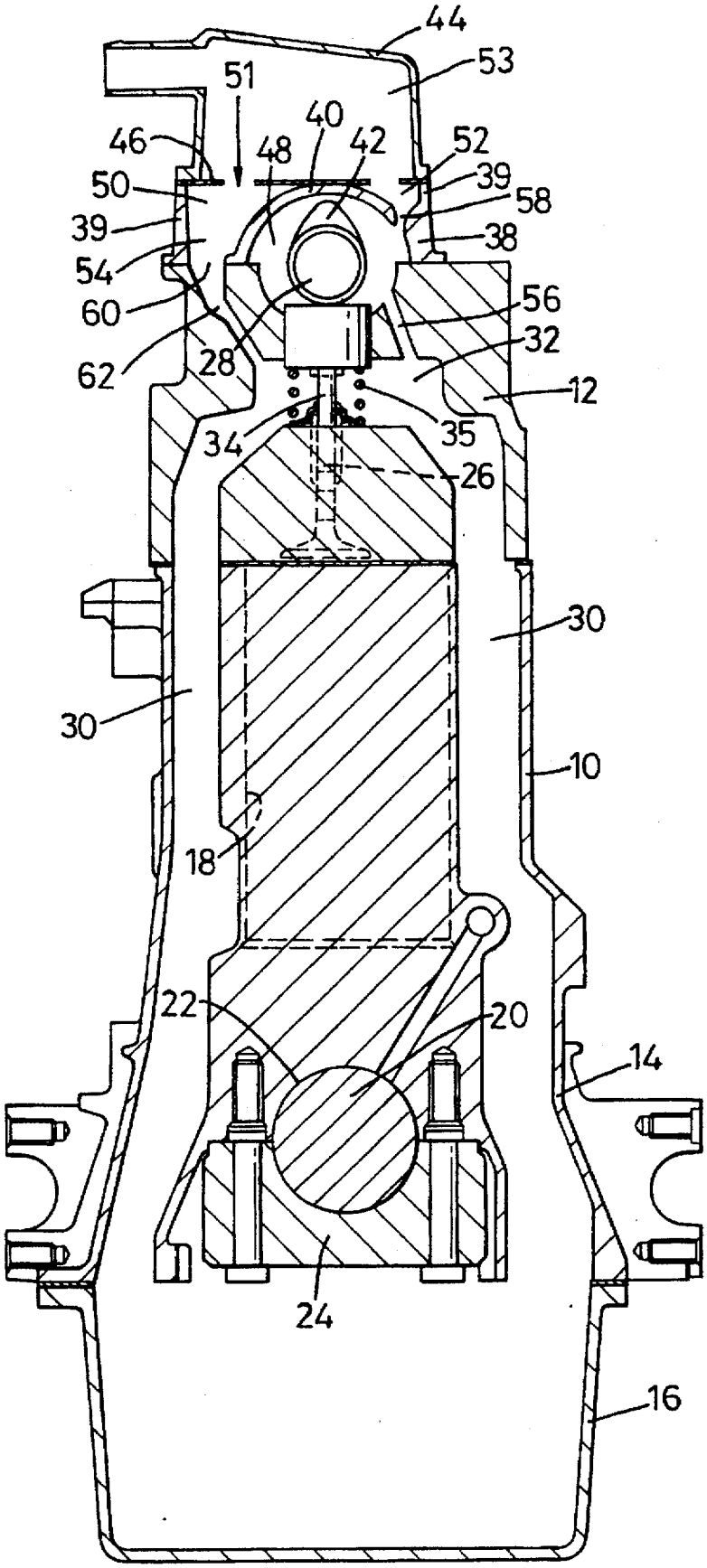
FIG. 1 is a schematic scrap section through an engine according to the invention.

Referring to the drawings, an engine comprises a cylinder block 10, a cylinder head casting 12, a crankcase 14 formed integrally with the cylinder block, and a sump 16. The block 10 defines four cylinder bores 18. A crankshaft 20 is supported between bearing caps 22 and a crankshaft bearing ladder 24. Inlet and exhaust valves 26 in the head 12 are operated by a camshaft 28.

Six oil drainage passages 30, three pairs of two on opposite sides of the engine, extend vertically through the block 10 and the lower part of the head casting 12. Each pair converges in a respective chamber 32 in the head casting 12 surrounding the stems 34 and springs 35 of the valves of one of the cylinders. Oil from this part of the valves can therefore drain down the oil drainage passages 30.

Figure 2:
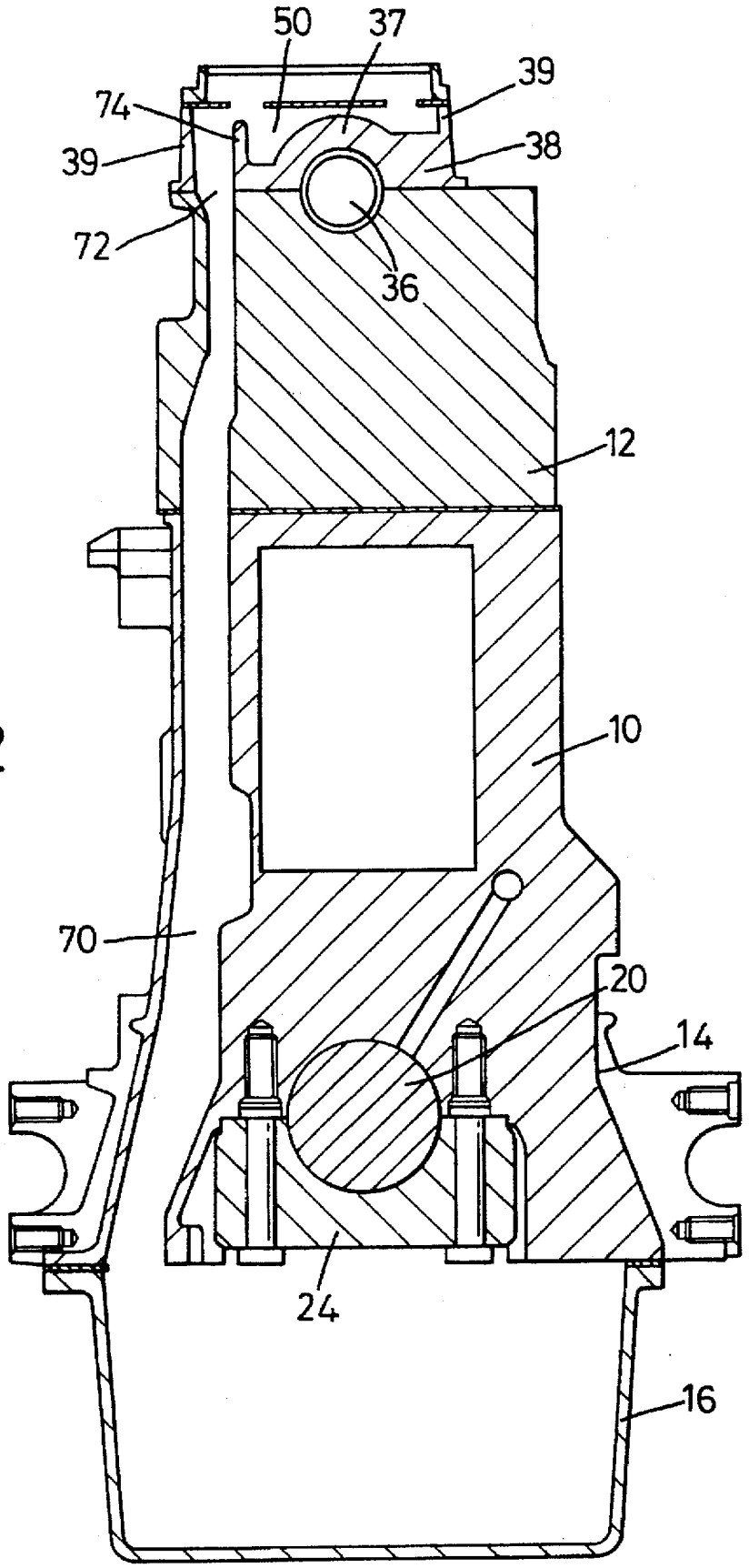
FIG. 2 is a schematic scrap section parallel to that of FIG. 1 through the engine of FIG. 1.
Figure 3:
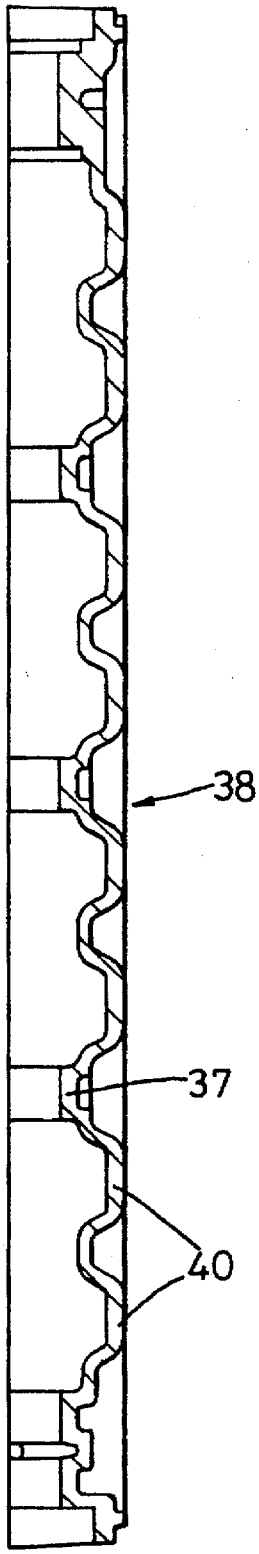
FIG. 3 is a section through a camshaft guard of the engine of FIG. 1.
Figure 4:
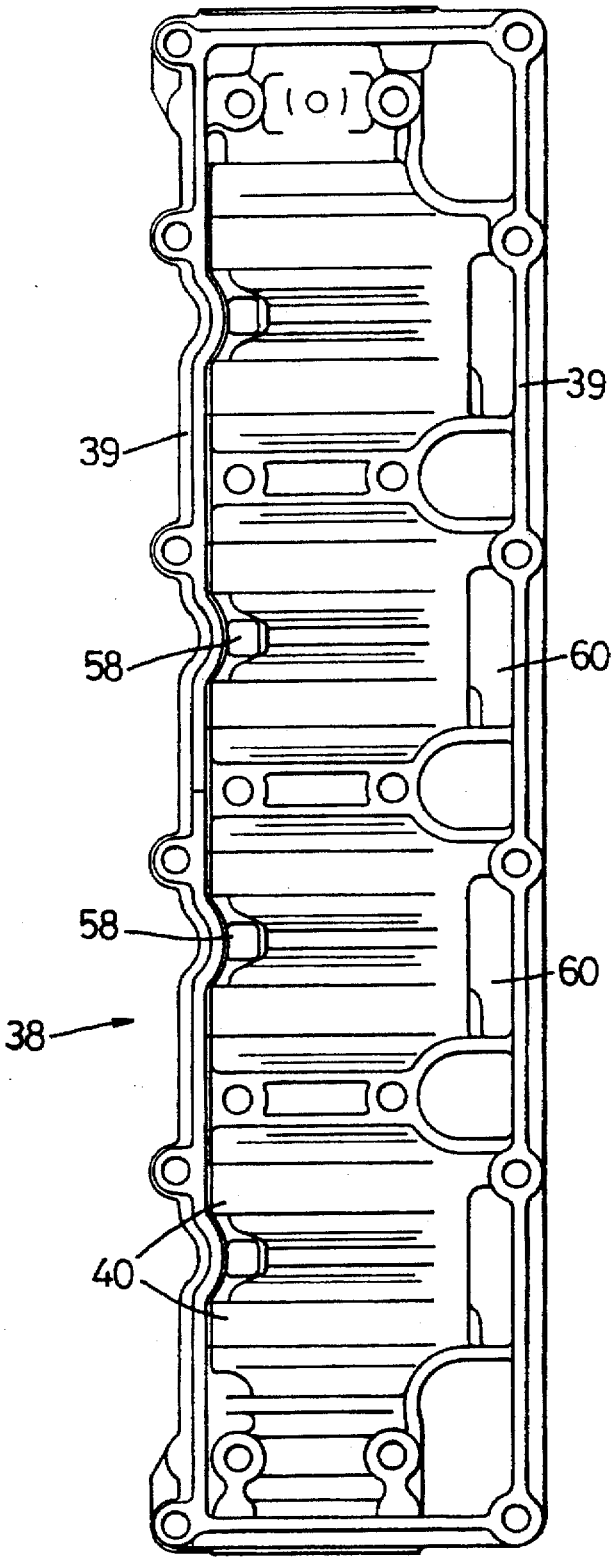
FIG. 4 is a plan view of the guard shown in FIG. 3.
Figure 5:
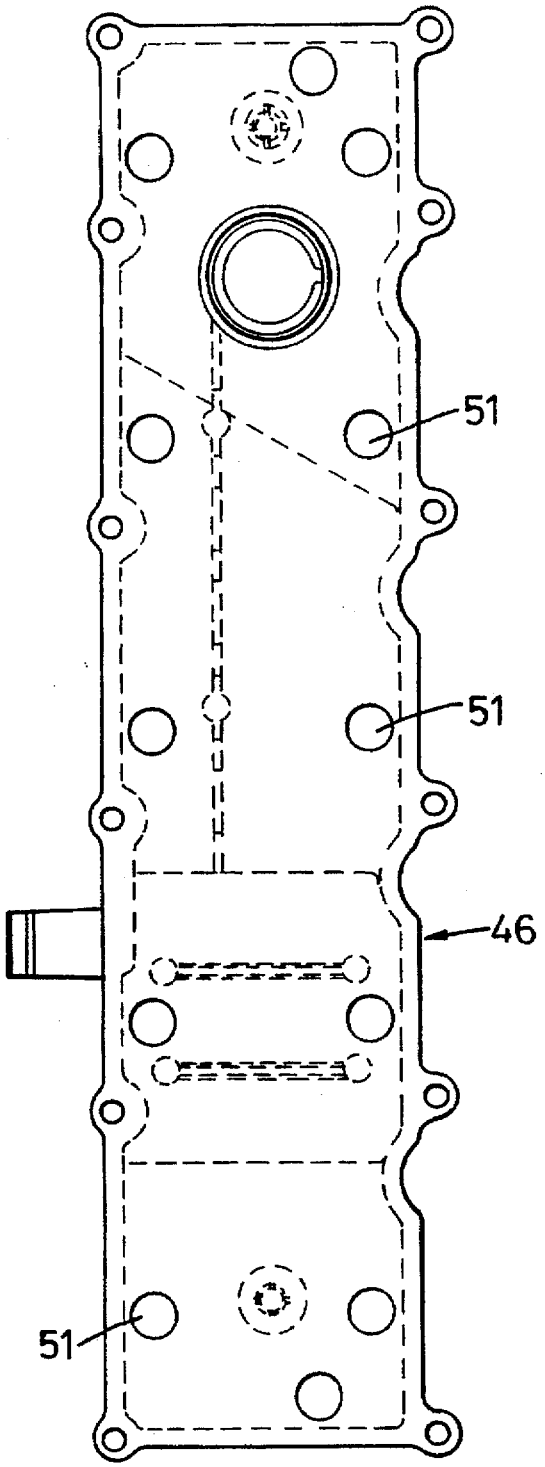
FIG. 5 is a view from below of a gasket of the engine of FIG. 1.
Figure 6:
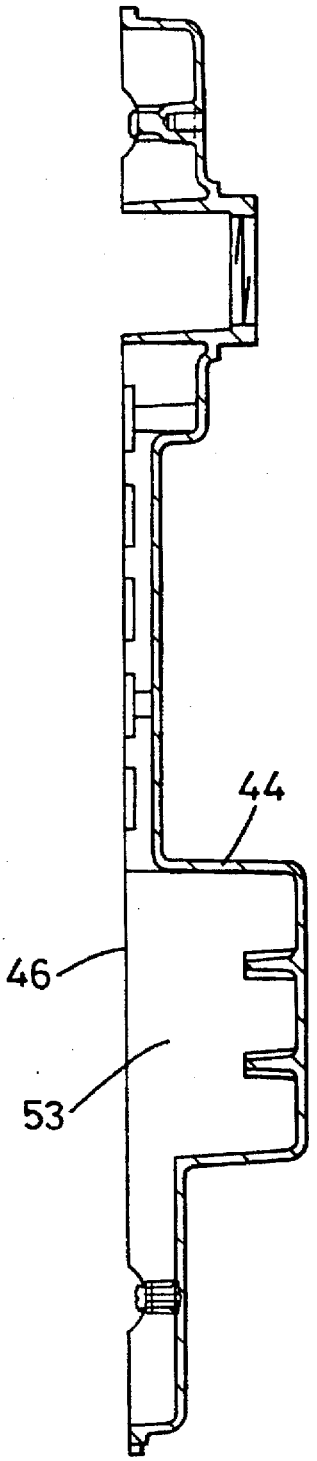
FIG. 6 is a section through the gasket and cover of the engine of FIG. 1.

As shown in FIG. 2 the camshaft 28 is supported in five bearings 36 which are each formed from bearing portions of the head casting 12 and a camshaft bearing ladder 37. The camshaft bearing ladder 37 has bearing portions forming the upper part of each of the camshaft bearings and is formed as part of a single cast component in the form of a guard member 38 which also includes side walls 39 and guards 40 which extend over the top of the cams 42 on the camshaft as shown in FIG. 1. A cover 44 is mounted on the side walls 39 of the guard member 38, a gasket 46 being interposed between the guard member 38 and the cover 44. The guards 40 and the head casting 12 form enclosed chambers 48 which enclose the cams 42. A separation region 50, the function of which will be described later, is defined between the guard member 38 and the gasket 46, and is separated from the cam chambers 48 by the guards 40. Holes 51 through the gasket form outlets from the separation region 50, connecting it to an outlet region 53 defined by the cover. The guards 40 are arched over the cams 42 and there is a shallow gully 52 between each guard and one of the side walls 39 of the guard member 38, and a deeper gully 54 between each guard and the other of the side walls 39. A drilling 56 connects each of the cam chambers 48 to one of the chambers 32 allowing oil to drain from the cams into the oil drainage passages. An opening 58 in the guards 40 connects each of the shallow gullies 52 to the cam chambers 48. Each of the deep gullies 54 has a long opening 60 in the bottom which leads via a funnel shaped passage 62 in the head casting 12 to one of the chambers 32.

As shown in FIG. 2, at each end of the engine a breather passage 70 extends from the crankcase 14 up through the block 10 and the head casting 12. An aperture 72 in the guard member 38 forms an inlet to the separation region 50 which is connected to the breather passages 70. A raised wall 74 around the aperture 72 prevents oil from draining down the breather passages 70 from the separation region 50.

When the engine is running oil runs down the oil drainage passages 30 from the camshaft 28 and valves 26. Because of this and because of the relatively restricted nature of the connection between the oil drainage passages 30 and the separation region 50, blow-by gasses from the cylinders which pass out into the crankcase 14 and sump 16 tend to escape via the breather passages 70. When these gases pass out of the narrow breather passages 70 into the separation region, which obviously has a much larger cross section than the inlet to the separation region, they slow down. Also because the holes 51 in the gasket 46 are spread along the gasket and offset from the inlet 72 to the separation region, the gas travels in a substantially horizontal direction through the separation region. This allows oil droplets in the blow-by gases to drop out and be deposited on the top of the guards 40. From there the oil drains down through the openings 58, 60 into the oil drainage passages. Oil thrown off the cams 42 as they rotate is kept separate from the separation region 50 by the guards 40. The air which rises up through the holes 51 into the outlet region 53 is therefore relatively clean and free of oil.

What is claimed is:

1. An internal combustion engine having a cylinder head assembly including a camshaft with a plurality of cams and camshaft bearings supporting the camshaft, the head assembly defining at least one breather passage extending therethrough and an oil separation region, the oil separation region having an outlet and also having an inlet connected to said at least one breather passage such that, in use, gas can flow from said at least one breather passage through the oil separation region where oil can separate out of the gas, wherein the head assembly further comprises a cover defining an outlet region, a gasket, and a guard member, the guard member having guard portions which separate the oil separation region from the cams, and the guard member further comprising camshaft bearing portions, and the gasket separates the outlet region from the separation region and has apertures therethrough which form the outlet and are offset from the inlet.

2. An engine according to claim 1 wherein the cross section of the separation region is significantly larger than that of said at least one breather passage such that, in use, the gas is slowed down in the separation region.

3. An engine according to claim 1 wherein the separation region is arranged such that, in use, the flow of the gas through the separation region has a significant horizontal component.

4. An engine according to claim 1 wherein the guard member includes a guard extending over each of said cams.

5. An engine according to claim 1 wherein the head assembly includes a cylinder head member, the guard member being mounted on the head member and the cover being mounted on the guard member.

6. An engine according to claim 5 wherein the head member has camshaft bearing portions which cooperate with a camshaft bearing ladder on the guard member to form the camshaft bearings.

7. An engine according to claim 1 wherein the guard member has an aperture therethrough connecting one of the breather passages to the separation region and wall means around the aperture to prevent oil draining down said breather passage from the separation region.

8. An internal combustion engine having a cylinder head assembly including a camshaft with a plurality of cams and camshaft bearings supporting the camshaft, the head assembly defining at least one breather passage extending therethrough and an oil separation region connected to said at least one breather passage such that, in use, gas can flow from said at least one breather passage through the separation region where oil can separate out of the gas, wherein the head assembly further comprises, a guard member having guard portions which separate the oil separation region from the cams and camshaft bearing portions;

a cover defining an outlet region; and a gasket separating the outlet region from the separation region.

9. An internal combustion engine having a cylinder head assembly including a camshaft with a plurality of cams and camshaft bearings supporting the camshaft, the head assembly defining at least one breather passage extending therethrough and an oil separation region connected to said at least one breather passage such that, in use, gas can flow from said at least one breather passage through the separation region where oil can separate out of the gas, wherein the head assembly further comprises a guard member having guard portions formed in part by each of the camshaft bearings which separate the oil separation region from the cams and camshaft bearing portions.

* * * * *